US011306917B2

(12) United States Patent
King, Jr.

(10) Patent No.: US 11,306,917 B2
(45) Date of Patent: Apr. 19, 2022

(54) FLUE CAP COVER

(71) Applicant: Roof Goose Vent LLC, North Kingstown, RI (US)

(72) Inventor: Jack F. King, Jr., North Kingstown, RI (US)

(73) Assignee: Roof Goose Vent LLC, North Kingstown, RI (US)

( * ) Notice: Subject to any disclaimer, the term of this patent is extended or adjusted under 35 U.S.C. 154(b) by 463 days.

(21) Appl. No.: 16/362,268

(22) Filed: Mar. 22, 2019

(65) Prior Publication Data

US 2019/0301736 A1 Oct. 3, 2019

Related U.S. Application Data

(60) Provisional application No. 62/648,678, filed on Mar. 27, 2018.

(51) Int. Cl.
*F23L 17/12* (2006.01)

(52) U.S. Cl.
CPC ..... *F23L 17/12* (2013.01)

(58) Field of Classification Search
CPC ..... F23J 2900/13005; F23J 2213/50; F23J 13/00; F23J 13/08; F23L 17/02; F23L 17/12; F23L 17/00; F23L 17/04
See application file for complete search history.

(56) References Cited

U.S. PATENT DOCUMENTS

| | | | | |
|---|---|---|---|---|
| 2,660,105 | A * | 11/1953 | Sabin, Jr. | F23L 17/02 55/509 |
| 3,315,586 | A | 4/1967 | Marrapese et al. | |
| 4,189,989 | A * | 2/1980 | Maze | F24F 7/02 454/368 |
| 4,206,692 | A | 6/1980 | Johnston | |
| 4,398,453 | A | 8/1983 | Wilkerson | |
| 5,062,354 | A | 11/1991 | Goins et al. | |
| 5,680,856 | A * | 10/1997 | van Dijk | F23J 13/04 126/307 R |
| 7,717,702 | B2 | 5/2010 | Aycock et al. | |
| 7,774,999 | B2 * | 8/2010 | McKee | F24F 7/02 454/368 |
| 8,298,053 | B2 * | 10/2012 | Parry | F23L 17/02 454/33 |
| 9,115,632 | B2 | 8/2015 | Wolfcarius et al. | |
| 9,328,514 | B1 * | 5/2016 | Thompson | F23J 13/04 |
| 2003/0110554 | A1 * | 6/2003 | Hernandez | F24F 7/02 454/367 |
| 2006/0211356 | A1 | 9/2006 | Grassman | |
| 2007/0095339 | A1 | 5/2007 | Lyons et al. | |
| 2007/0221195 | A1 | 9/2007 | Bibaud et al. | |
| 2010/0089382 | A1 | 4/2010 | Brown et al. | |

(Continued)

FOREIGN PATENT DOCUMENTS

| | | | |
|---|---|---|---|
| DE | 102005060133 | A1 | 6/2006 |
| EP | 1089038 | A1 | 4/2001 |

(Continued)

*Primary Examiner* — Steven S Anderson, II
(74) *Attorney, Agent, or Firm* — Breiner & Breiner, L.L.C.

(57) ABSTRACT

There is disclosed a flue cap cover for covering a flue cap extending from a building wall. The flue cap cover may be of different colors to match or contrast with the color of the building. The flue cap cover includes a cover, an optional mesh pest guard, a pipe ring and an optional trim ring.

14 Claims, 10 Drawing Sheets

(56) References Cited

U.S. PATENT DOCUMENTS

| | | | |
|---|---|---|---|
| 2011/0247603 | A1 | 10/2011 | Dempsey et al. |
| 2011/0294412 | A1 | 12/2011 | Vagedes |
| 2017/0191683 | A1 | 7/2017 | Seemann |
| 2017/0336073 | A1 | 11/2017 | Weir et al. |

FOREIGN PATENT DOCUMENTS

| | | | |
|---|---|---|---|
| EP | 1582813 | A2 | 10/2005 |
| GB | 1572691 | A | 7/1980 |
| KR | 20100004621 | U | 5/2010 |

* cited by examiner

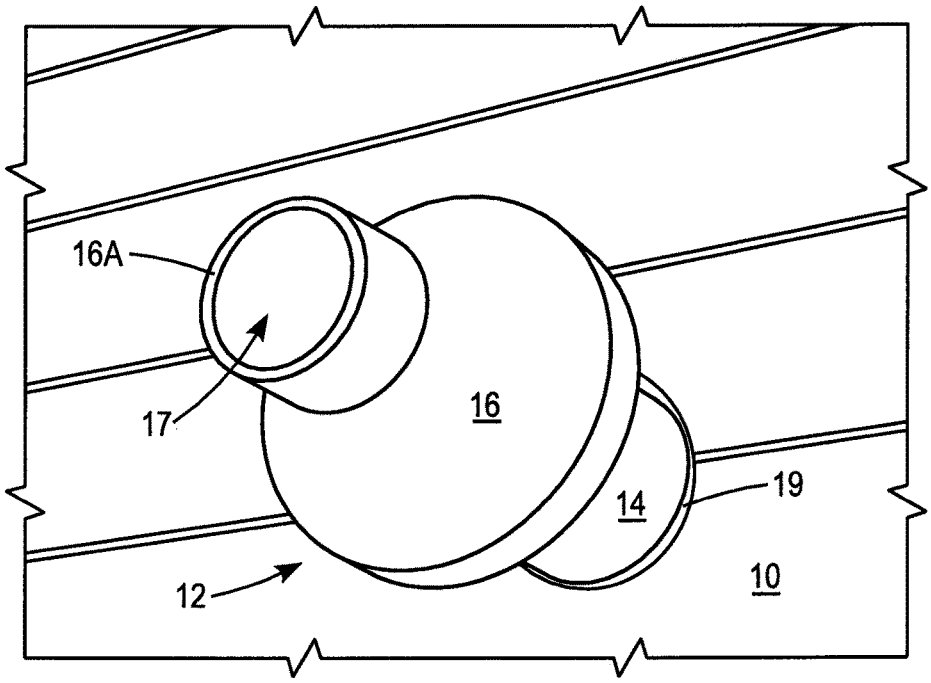
FIG. 1
PRIOR ART
FIG. 1A
PRIOR ART
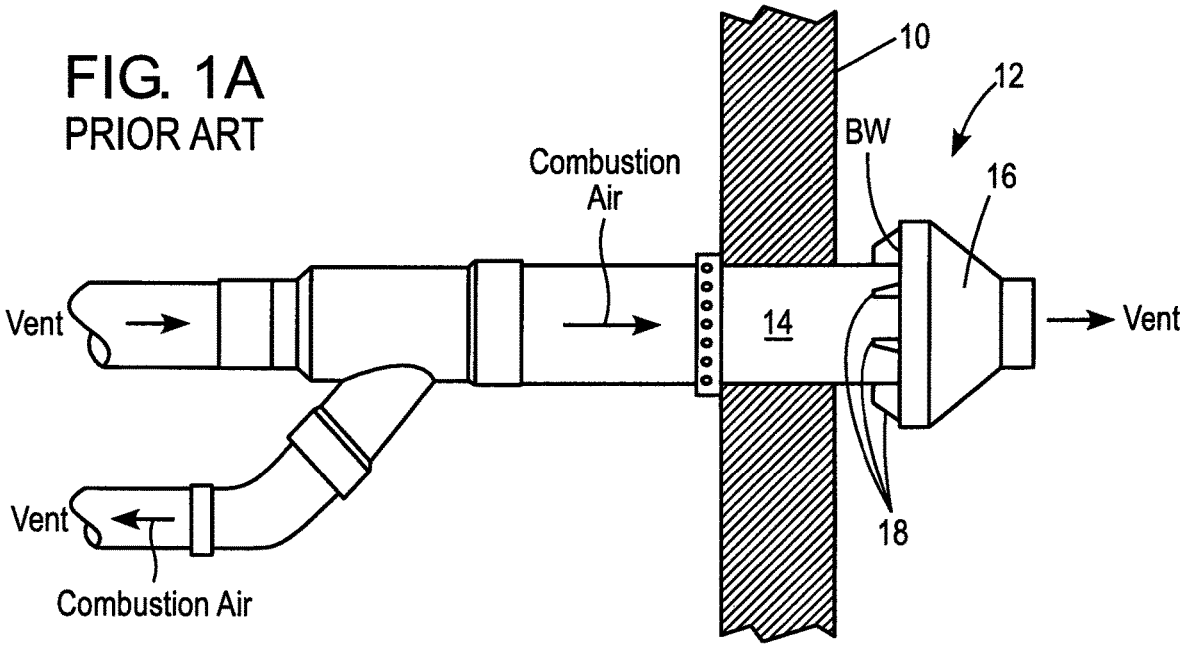

FLUE CAP COVER

RELATED APPLICATION

This application claims benefit of U.S. Provisional Application Ser. No. 62/648,678, filed Mar. 27, 2018, entitled "Flue Cap Cover," which application is incorporated herein by reference in its entirety.

FIELD OF THE INVENTION

The present invention relates to a concentric flue cap cover. More particularly, the invention relates to a flue cap cover comprising a cover, an optional pest guard, a pipe ring and an optional trim ring for covering a flue cap with different colored flue cap covers to match or contrast with the color of a building.

BACKGROUND OF THE INVENTION

The present invention is directed to a common problem in multi-family apartment buildings. The problem involves coordinating the color of flue covers with the color of the building and the contrasting textures and colors commonly used to make large buildings look like a collection of smaller buildings.

More particularly, the invention is directed to sidewall terminations for gas fired appliances such as shown in FIGS. 1 and 1A. On a large building, this may involve hundreds of flues projecting out from the side of a building as shown in FIG. 1. FIG. 1A shows a schematic of a flue and flue cap similar to FIG. 1. More specifically, referring to FIGS. 1 and 1A, there is shown a building wall 10 of a specific color having a flue 12 extending out of wall 10. The flue 12 includes a pipe 14 and flue cap 16. Flue cap 16 is usually attached to pipe 14 by friction fit. Flue cap 16 includes an opening 17 for venting combustion air and a plurality of ribs 18, e.g. six, which surround pipe 14 and connect flue cap 16 to pipe 14 by friction fit. Ribs 18 include ledges (not shown) which seat on the top wall of pipe 14. The flue 12 is usually made of plastic such as PVC and is white. Referring to FIG. 1, there is an opening 19 in wall 10 through which pipe 14 extends. This is usually cut with a saw and leaves opening 19 which in some instances may be quite large, jagged and/or unsightly. This opening 19 may be sealed with caulking to close the opening.

A general contractor for a building usually requests that the supplying sub-contractor paint the flue cap termination as shown, for example, in FIG. 1. For bathroom exhaust and other side wall exhaust penetration covers, as opposed to flue covers, this can be difficult but is manageable most of the time. Many typical sidewall hoods come in a myriad of colors or because they are made out of metal they can be professionally painted and adhesion is not an issue. For example, an HVAC contractor may give bathroom exhaust covers to a body shop or the project's painting subcontractor to paint the covers. The HVAC contractor then installs the colored bathroom exhaust covers at the tail end of the construction project. These covers are the final trim in the construction and not integral to the construction.

A difficulty lies in painting flue covers such as shown in FIGS. 1 and 1A. These are PVC assemblies and PVC does not take paint well, especially once it is in its final installed position up in the air on the building. It is hard to properly prepare the surface in the outdoors and the painting is weather dependent. Many waterproofing systems rely on mastics or tapes which further complicate the painting of the original surface. Accordingly, there is no simple and inexpensive way of painting flue caps 16.

Another problem is that the flue caps 16 get installed early on in the construction and are integral to the flue itself. Therefore, the best practice process of having a painter paint them in a heated shop is not practical. To pre-paint them and then install them is also not practical. They get scratched up by all of the trades long before completion of the construction project. Additionally, often no one has a schedule of exterior colors of a building when this component is being installed. The ability to quickly use a boom lift to snap on a flue cap cover of multiple colors such as black, brown, tan, red, grey or bronze at the tail end of a construction project would be ideal and save substantial time and expense, e.g. requiring much less planning and coordination of the construction contractor.

Accordingly, the current flue caps have shortcomings in painting the caps to match a building. They are only available in white. These and other shortcomings of the known flue caps are addressed by the present invention.

SUMMARY OF THE INVENTION

A primary object of the present invention is to provide a flue cap cover in multiple stock colors to compliment common siding materials for buildings.

Another primary object of the present invention is to provide a flue cap cover to cover a flue cap extending from a building.

Another primary object of the present invention is to provide a flue cap cover to cover a flue cap extending from a building and which may be of multiple colors to match or contrast with the building color and be installed at the end of a construction project.

Another primary object of the present invention is to provide a flue cap cover for covering a flue cap extending from a building comprising a cover and a pipe ring, the cover and the pipe ring being of a color to match or contrast with a building color.

Another primary object of the present invention is to provide a flue cap cover for covering a flue cap extending from a building comprising a cover, a pipe ring and a trim ring; and the cover, the pipe ring and the trim ring being of a color to match or contrast with a building color.

Another primary object of the present invention is to provide a flue cap cover comprising a cover, a pipe ring, a trim ring, and optionally having a stainless steel mesh screen at the end of the cover.

Another primary object of the present invention is to provide a flue cap cover which is simple in construction; inexpensive to manufacturer; and easy and inexpensive to install in any temperature or weather condition.

Another primary object of the present invention is to provide a flue cap cover which is easy to install on a construction project at a selected stage of the construction project and which may be of multiple colors to match or contrast with a building color.

Another primary object of the present invention is to provide for pest control at the outlet using a stainless steel free flowing mesh.

The present invention is directed to a flue cap cover comprising a cover, an optional stainless steel mesh, a pipe ring and an optional trim ring.

The present invention is further directed to a flue cap cover for covering a flue termination having a flue pipe and flue cap comprising a cover, an optional stainless steel mesh, a pipe ring and an optional trim ring. The pipe ring is adapted to slide over the flue pipe and receive the flue termination. The trim ring is adapted to fit over the pipe ring and cover any opening in the building wall and function as a flashing. The cover may contain an optional stainless steel mesh and overlays and attaches to the flue cap. The flue cap cover may be of multiple colors adapted to match or contrast with the color of a building.

The present invention is further directed to a method of attachment of a flue cap cover to a flue cap wherein the flue cap includes a flue pipe and flue cap. In the method of the invention, the flue cap is removed from a flue pipe; a pipe ring of a specific color matching or contrasting to a building color is attached to the pipe of the flue; an optional trim ring of a specific color matching or contrasting to a building color is adapted to fit over the pipe ring and cover any opening in the building wall and function as a flashing and when used is first fit over the flue pipe and then the pipe ring is attached and the trim ring is slid over the pipe ring; the flue cap is re-attached to the flue pipe; and a cover is attached over the flue cap and the cover is a color the same as the pipe ring and optional trim ring and is designed to match or contrast with the building color. The attachment of the cover to the flue cap may be by a lip attached to tabs of the pipe ring, or flexible flanges of the cover attached to the flue cap or similar means and requires no tools, glues, fasteners or drilling. In one preferred embodiment, the method of the invention is undertaken at the end of a job and a worker is moved on a boom lift to each flue cap extending from the building and the flue cap cover is attached to the flue cap in this method.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings:

FIG. 1 illustrates a prior, art flue termination extending from a building wall.

FIG. 1A is a schematic of the flue termination shown in FIG. 1.

DETAILED DESCRIPTION OF THE PREFERRED EMBODIMENTS

The present invention in directed to a flue cap cover. The flue cap cover is used to cover a flue cap termination extending from a building wall such as shown in FIGS. 1 and 1A. The flue cap cover may be made of multiple colors to match or contrast with the color of a building wall. The flue cap cover invention will save contractors the substantial time and expense incurred in the present process of painting the flue caps as shown, for example, in FIG. 1. It will also give architects and owners more design choices which currently are not exercised due to the problems associated with the field painting of the PVC flue cap terminations. The present invention is further directed to a method of installing the flue cap cover of the present invention.

Figure 2:
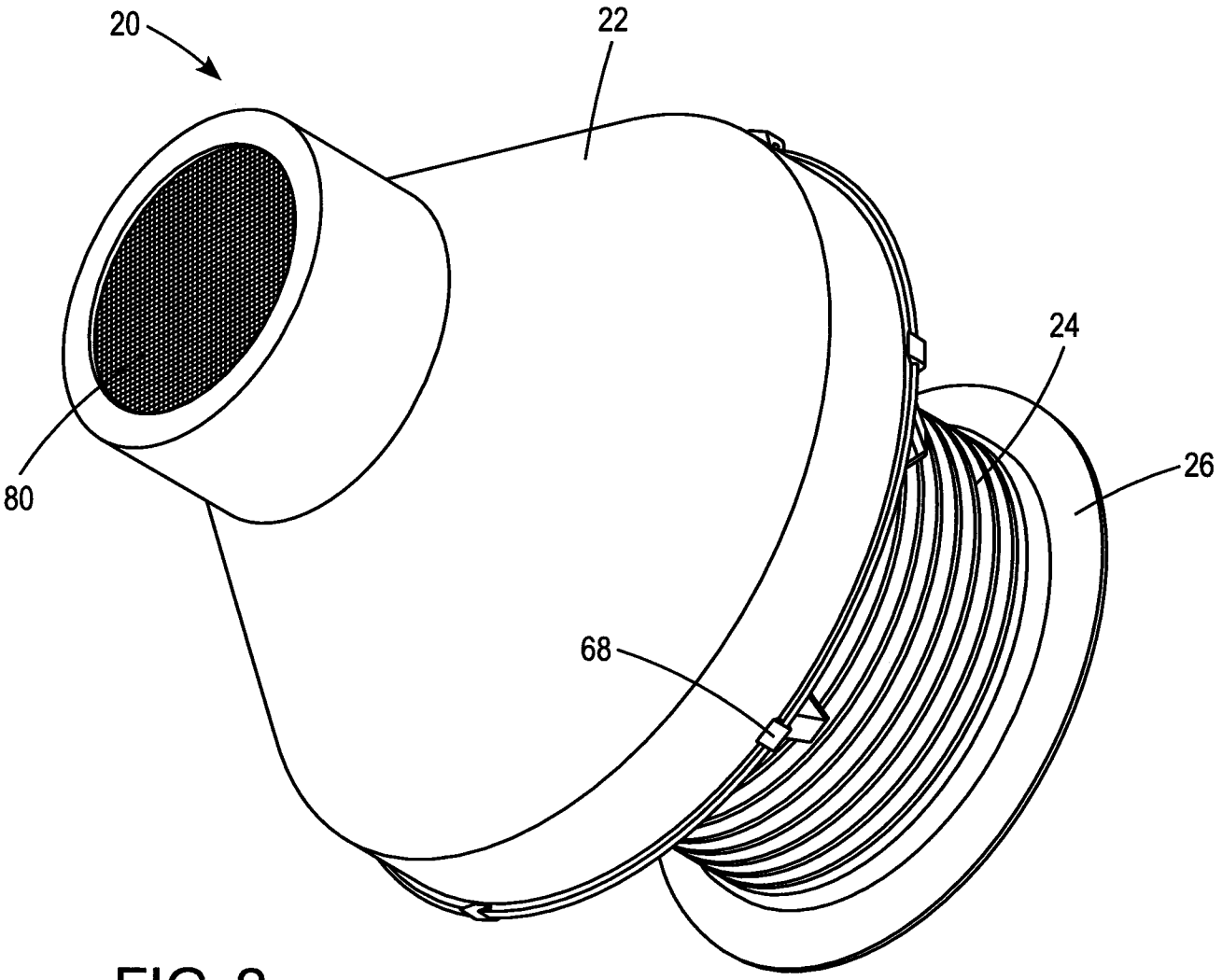
FIG. 2 is a perspective view of the flue cap cover of the present invention.
Figure 3:
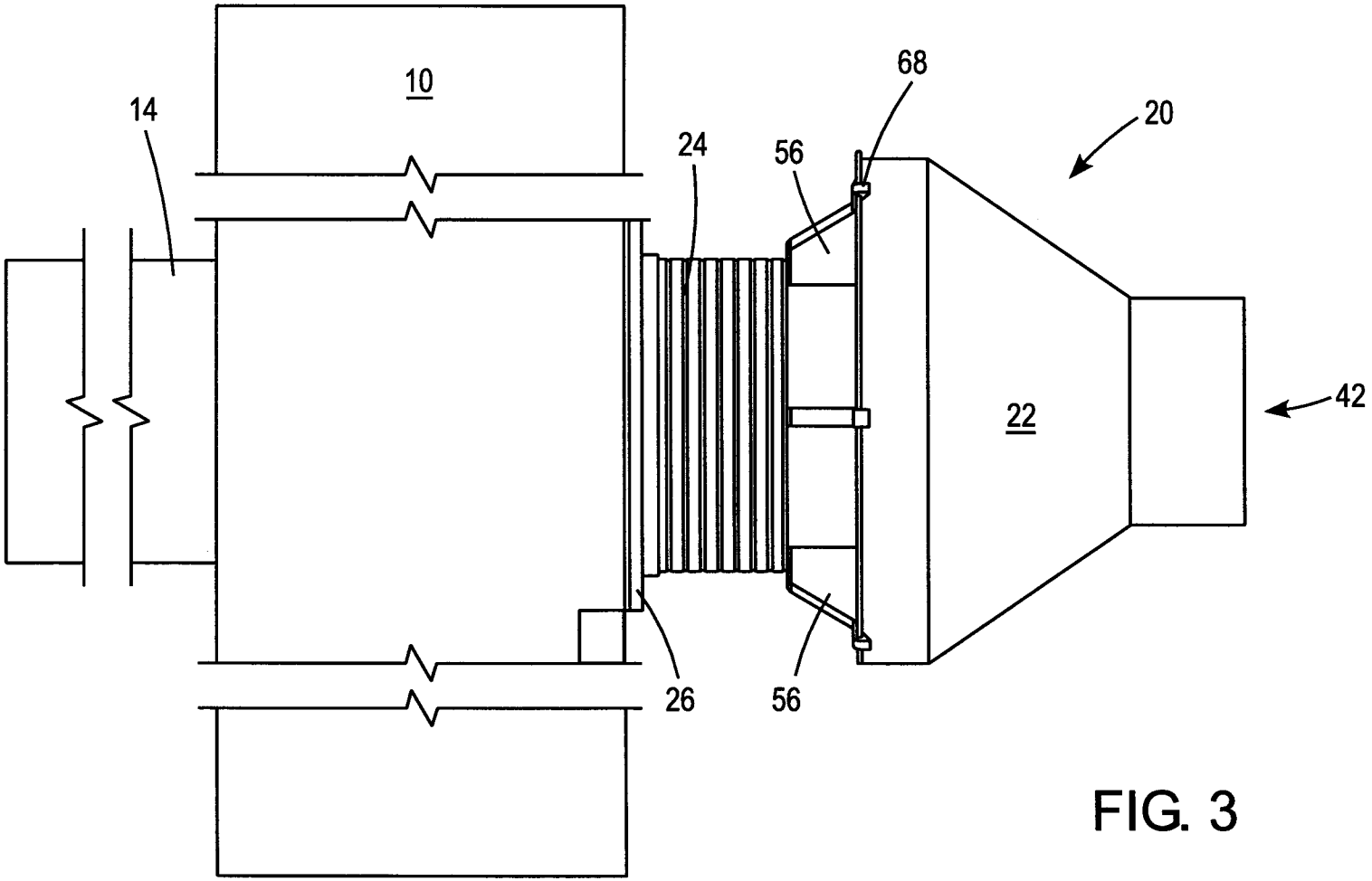
FIG. 3 is a side view of the flue cap cover of FIG. 2 installed on a flue cap of a building.
Figure 4:
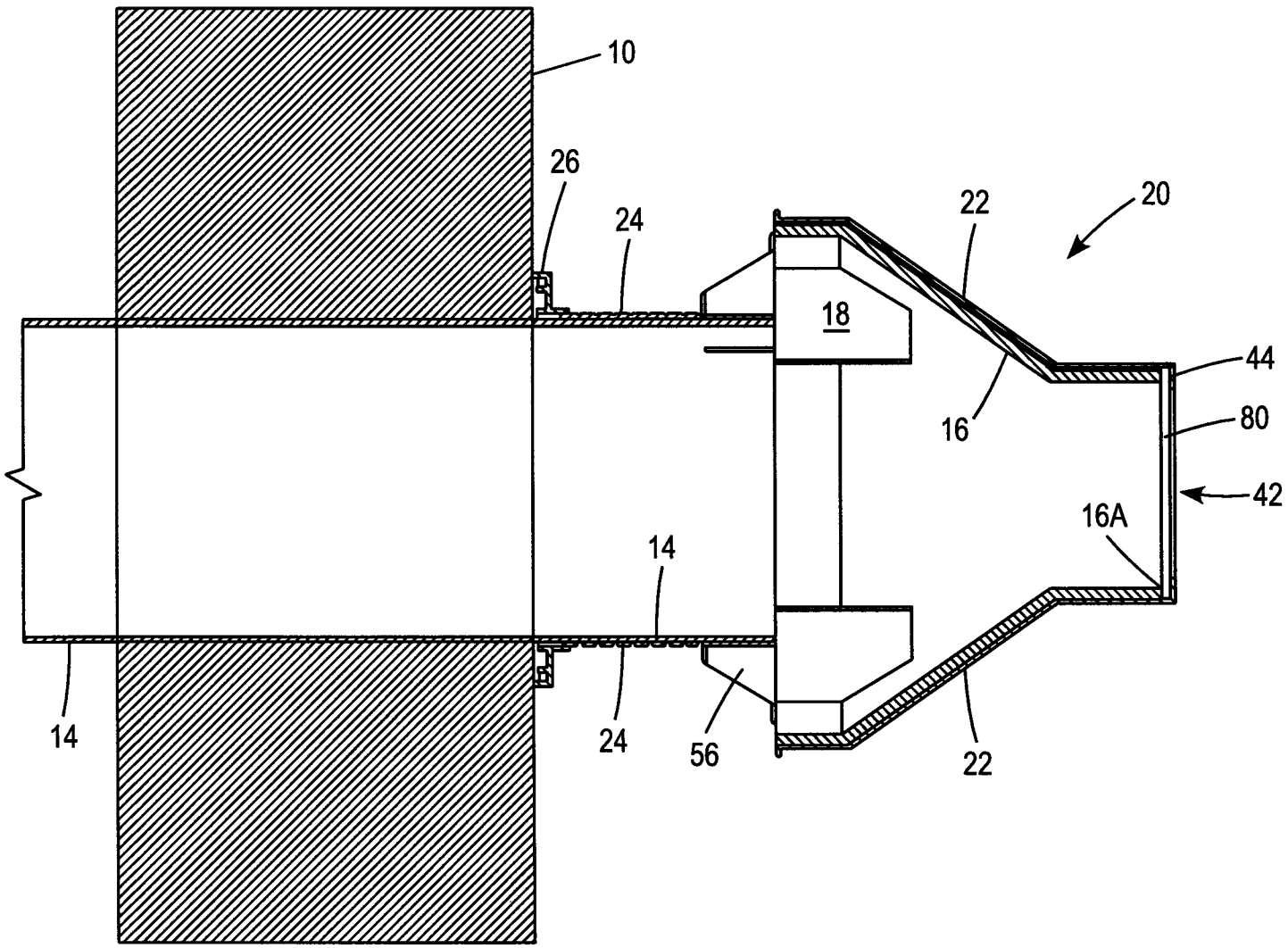
FIG. 4 is a cross-section of the flue cap cover of FIG. 3.

Referring to FIGS. 2-4, the present invention comprises a flue cap cover 20 having a cover 22, a pipe ring 24 and an optional trim ring 26. The cover 22, pipe ring 24 and trim ring 26 are preferably made of plastic such as UV stabilized PVC and are preferably made by molding. The cover 22, pipe ring 24 and trim ring 26 are usually made of the same color and a color which will match or contrast with the color of a building wall. It is understood that the cover 22, pipe ring 24 and trim ring 26 may be of different colors or different shades. As seen, for example, in FIG. 4, the pipe ring 24 is attached to flue pipe 14 and ribs 18 of flue cap 16 engage pipe ring 24. Cover 22 overlays flue cap 16 as discussed below. When used, optional trim ring 26 slides over a collar portion of pipe ring 24.

Figure 5A:
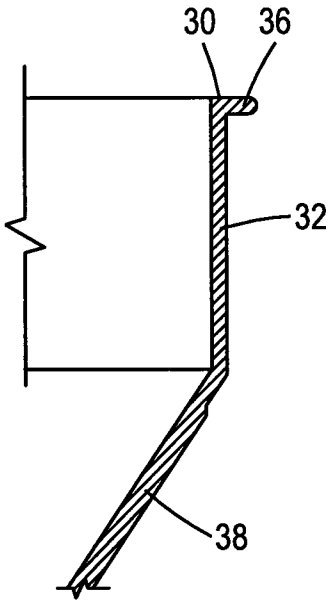
FIG. 5A is an enlarged cross-sectional view of section 5A of FIG. 5.
Figure 5:
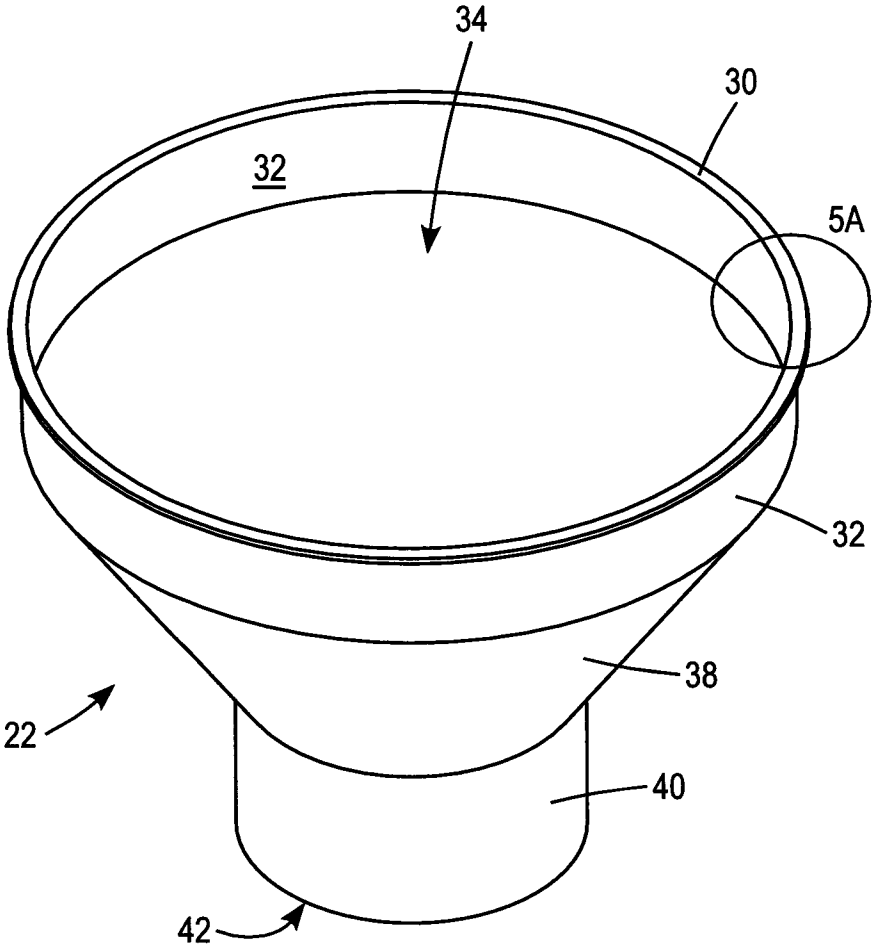
FIG. 5 is a perspective view of the cover of the flue cap cover of FIG. 2
Figure 5B:
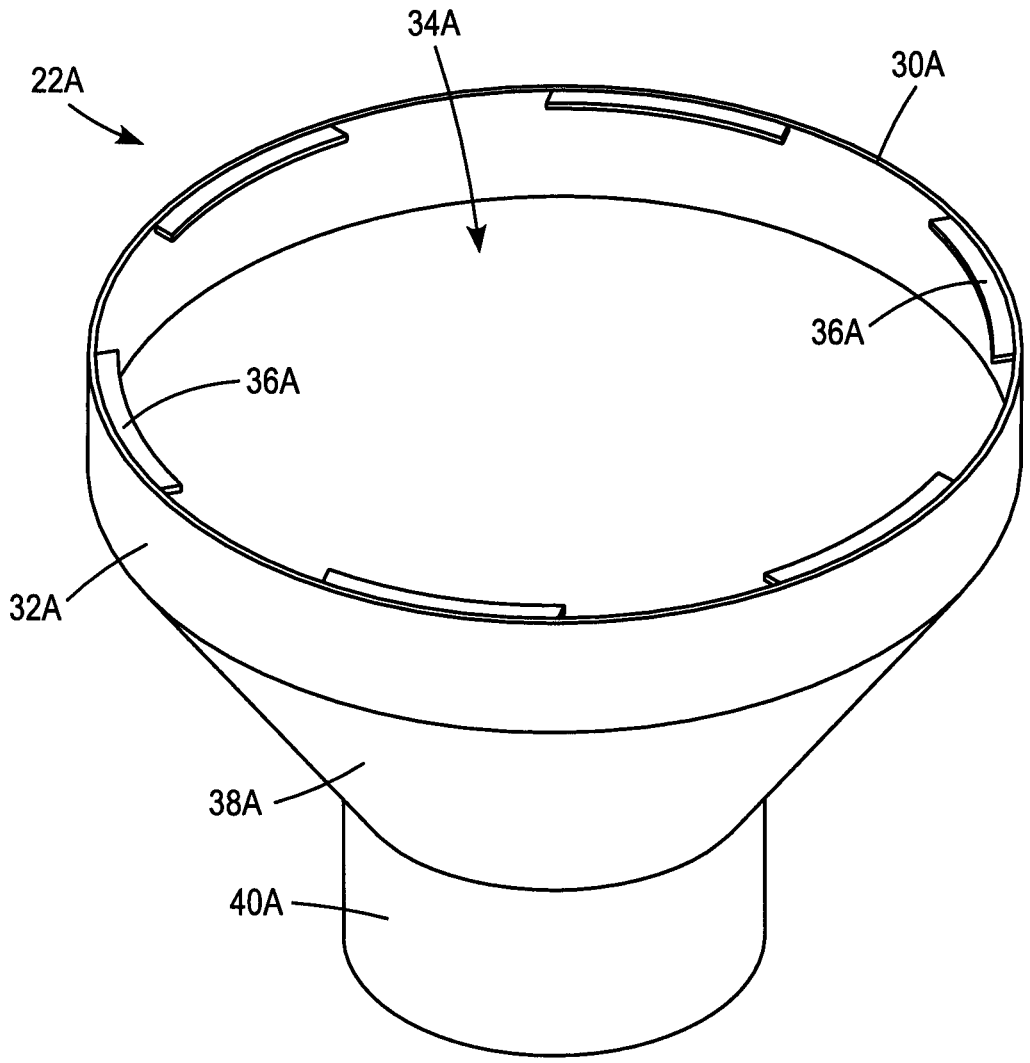
FIG. 5B is a perspective view of an alternative embodiment of a cover for the flue cap cover.

Referring to FIGS. 2-5, the cover 22 is generally cone shaped and designed to mate with the flue cap 16 as shown, for example, in FIGS. 3 and 4. However, it is understood that the flue cap cover 20 may be different shapes depending on the shape of the flue cap 16. Cover 22 comprises a bottom wall 30 having an annular vertical wall 32 and having an opening 34 at the bottom of the cover 22. The bottom wall 30 includes a lip 36 as shown, for example, in FIG. 5A for attaching the cover 22 to pipe ring 24. The lip 36 mates with corresponding tabs 68 on pipe ring 24 to hold the cover 20 in place. It is understood that other means may be used to attach cover 20 to flue cap 16 without departing from the scope of the invention, including as shown in FIG. 5B. Cover 22 further comprises a side wall 38 which is cone-shaped and a top wall 40 which is ring-shaped and has an opening 42. Openings 34 and 42 and the corresponding openings of the flue cap 16 serve to allow exhaust to exit from the flue and also for attachment of the cover 22 to the underlying flue cap 16. The cover 22 is preferably one piece and preferably made by molding in a number of colors, generally colors which match or contrast with a building color.

Referring to FIG. 5B, there is shown an alternative embodiment of a cover 22A for the flue cap cover 20. This cover 22A is generally cone shaped and designed to mate with the flue cap 16. However, it is understood that the flue cap cover 20 may be different shapes depending on the shape of the flue cap 16. Cover 22A comprises a bottom wall 30A having an annular vertical wall 32A and having an opening 34A at the bottom of the cover 22A. The bottom wall 30A includes flexible flanges 36A for attaching the cover 22A to the flue cap 16. The flanges 36A fit over the bottom wall BW of flue cap 16 to hold the cover 22A in place. Cover 22A further comprises a side wall 38A which is cone-shaped and a top wall 40A which is ring-shaped and has an opening 42A. Openings 34A and 42A serve to allow exhaust to exit from the flue and also for attachment of flue cap cover 20 to the underlying flue cap 16. The cover 22A is one piece and preferably made by molding in a number of colors, generally colors which match or contrast with a building color. When using this cover 22A, the pipe ring will not include tabs 68.

Referring, for example, to FIGS. 2-4 and 6, pipe ring 24 comprises an annular vertical wall 50 having a lower collar portion 52 and an upper portion 54. A plurality of legs 56 extend outwardly from upper wall portion 54. Legs 56 include side walls 58 and 60 and end wall 62 with an opening 64 between side walls 58 and 60. Side walls 58 and 60 includes a top wall 66 and extending outwardly from top wall 66 is a somewhat L-shaped tab 68 having a vertical leg 70 and lip 72. Lip 72 and top wall 66 form a slot 74. Tab 68 is adapted to engage and receive lip 36 of cover 22 to attach cover 22 to pipe ring 24. The number of legs 56 corresponds to the number of ribs 18 of flue cap 16 and openings 64 are adapted to receive a bottom portion of ribs 18. In a preferred embodiment, the outer edge of the legs 56 are tapered inward from the top of vertical wall 50. Additionally, collar 52 includes a plurality of segments 74 separated by annular grooves 76. The segments, while providing an aesthetically pleasing appearance, serve as "guidelines" in the event that pipe ring 24 needs to be trimmed down to fit properly over flue pipe 14. Additionally, grooves 76 act as a "score-line" for accurate cutting of the collar portion, e.g. preventing an off-plumb angular cut. Since the area at grooves 76 is thinner, this also allows for easier cutting of the collar. Ring 24 is adapted to fit over pipe 14 of flue 12 and seat on or adjacent to wall 10 of a building.

Figure 6:
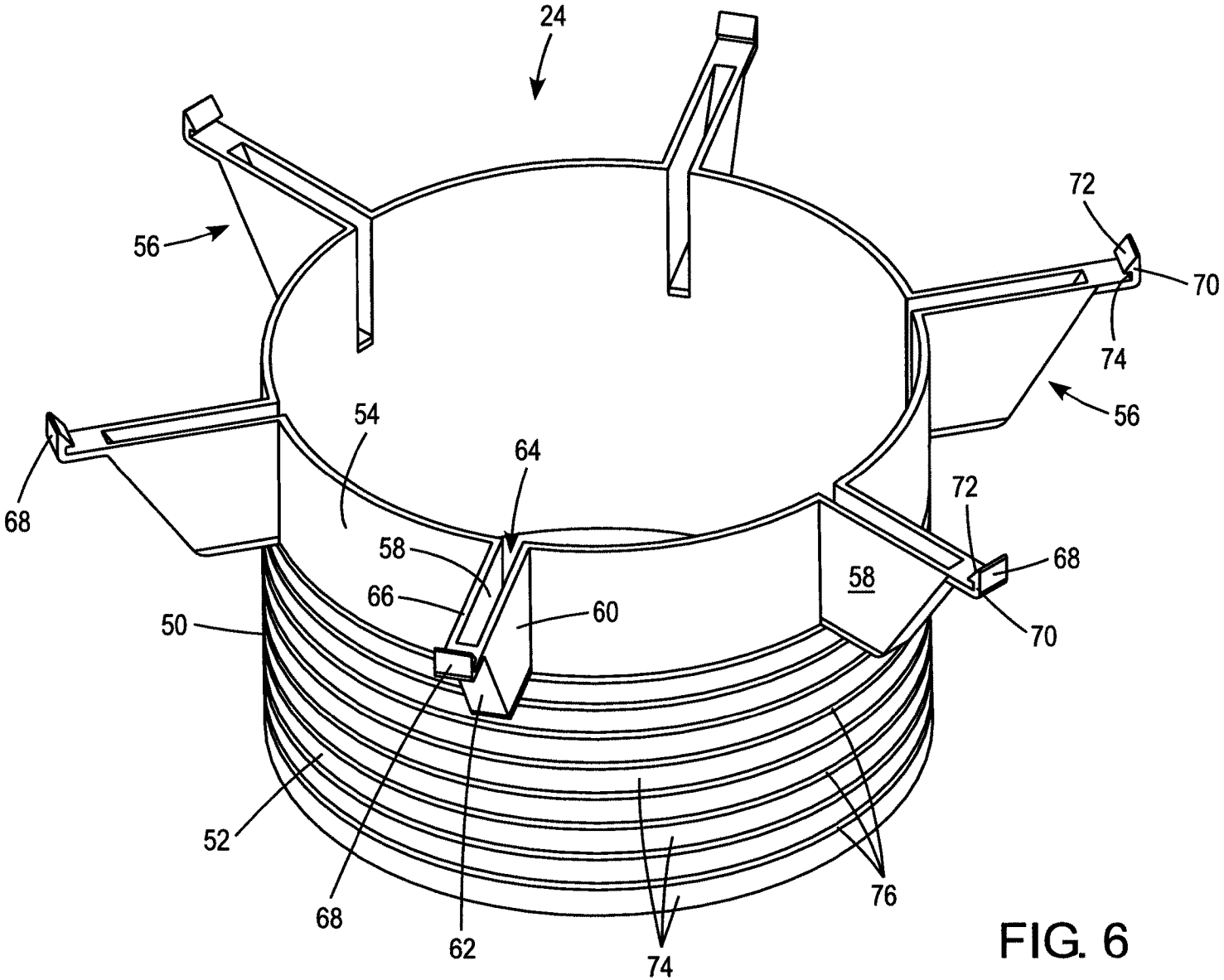
FIG. 6 is a perspective view of the pipe ring of the flue cap cover of FIG. 2.
Figure 6A:
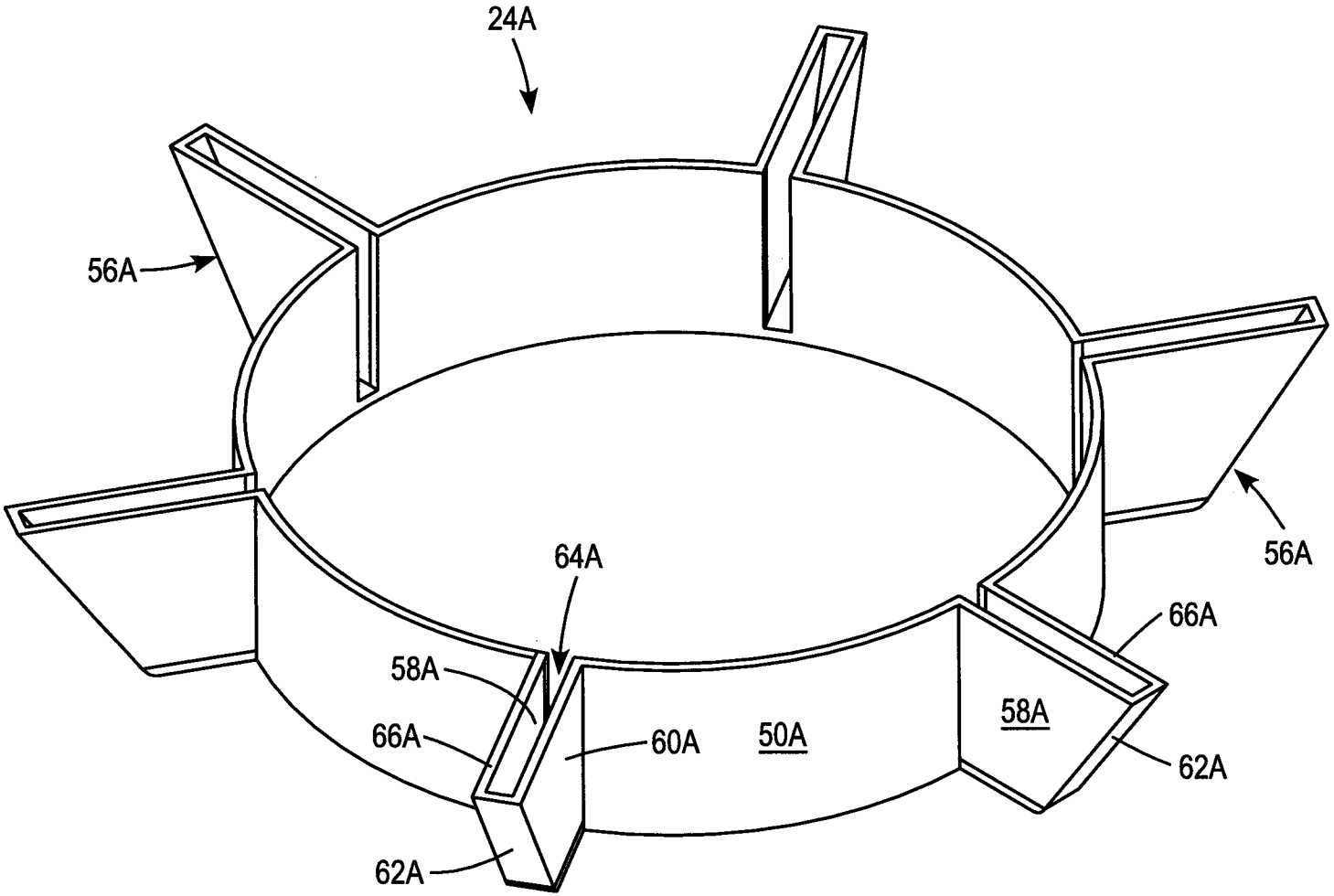
FIG. 6A is a perspective view of an alternative embodiment of a pipe ring for the flue cap cover.
Figure 7:
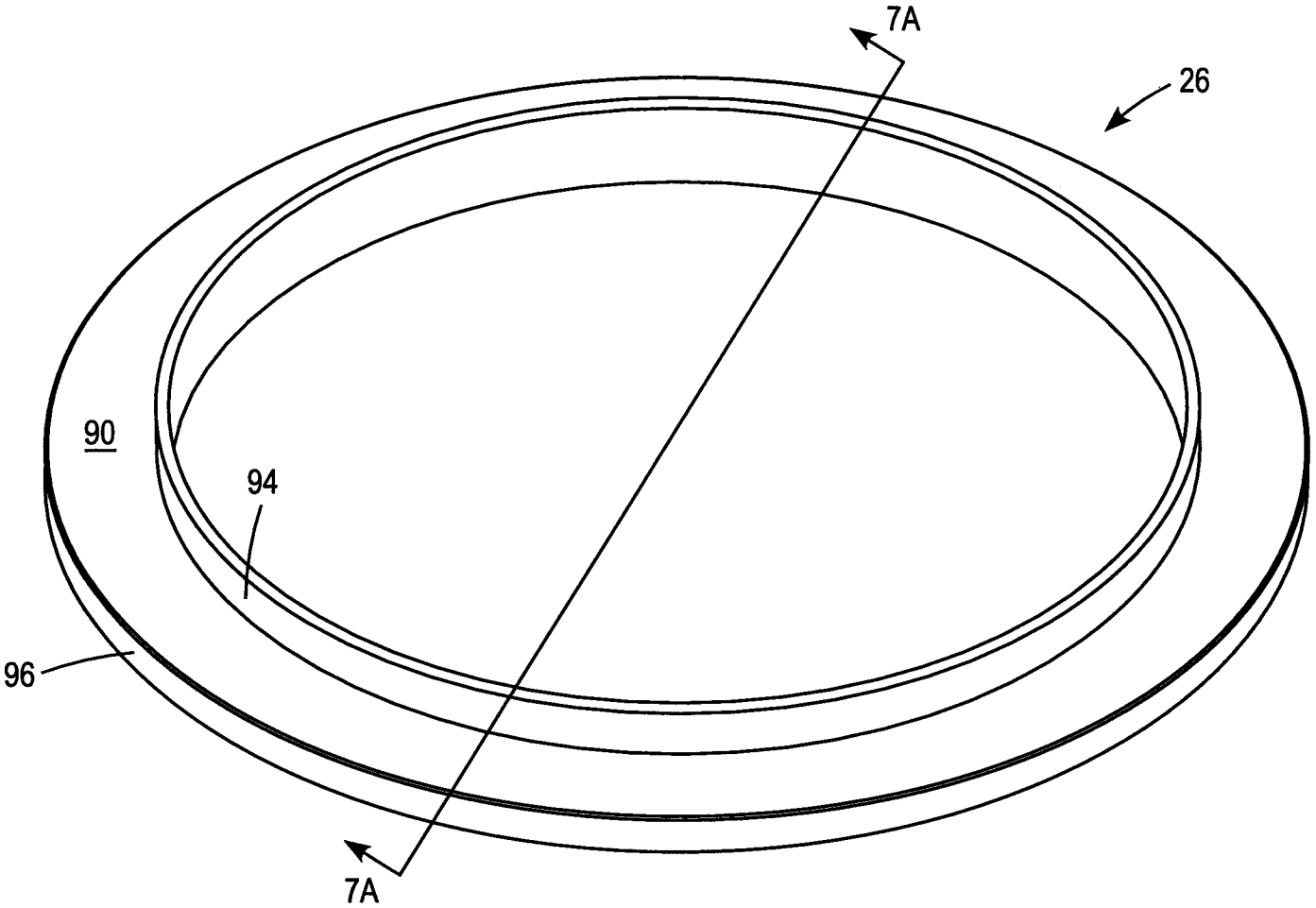
FIG. 7 is a perspective view of an optional trim ring of the flue cap cover of FIG. 2.
Figure 7A:
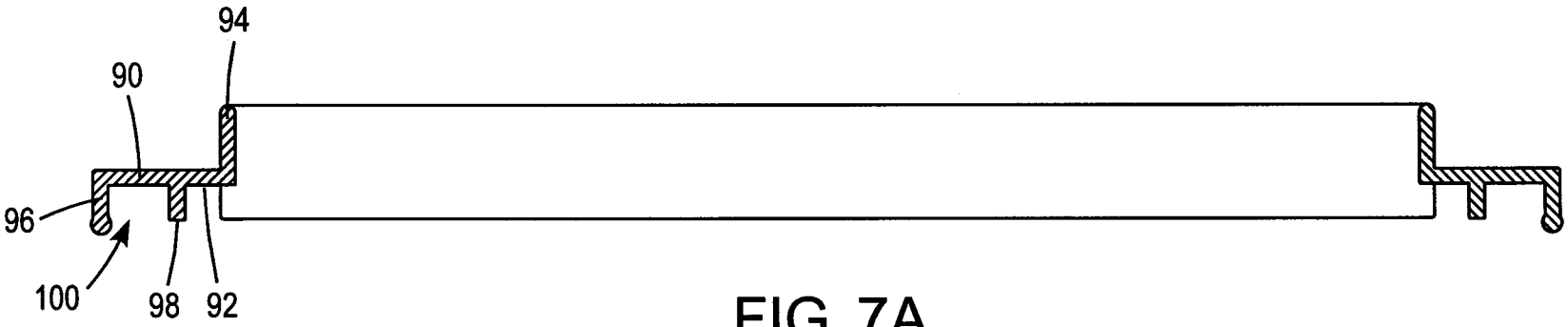
FIG. 7A is a cross-section of the trim ring of FIG. 7 taken along line 7A-7A.

Referring to FIG. 6A, there is shown an alternative embodiment of the pipe ring. This pipe ring 24A comprises an annular vertical wall 50A and extending outwardly from wall 50A are legs 56A having side walls 58A and 60A and end wall 62A with an opening 64A between side walls 58A and 60A. The number of legs 56A corresponds to the number of ribs 18 of flue cap 16 and openings 64A are adapted to receive a bottom potion of ribs 18. In a preferred embodiment, the outer edge of the legs 56A are tapered inward from the top of vertical wall 50A. Ring 24A is adapted to fit over pipe 14 of flue 12 and seat on or adjacent to wall 10 of a building. When using this pipe ring 24A, a cover such as 22A is used to attach the cover to flue cap 16. Similarly, this pipe ring 24A may include a collar such as on pipe ring 24 if a trim ring 26 is to be used.

Optionally, a screen 80 may be under a lip 44 of cover 22 (or 22A—not shown) to seat on a top wall 16A of flue cap 16 and held in place by cover 22 or 22A. This will allow exhaust to exit the flue and prevent animals or birds from entering the flue. This screen 80 overlays the existing exit of flue cap 16 and does not impact the interior diameter because it is sandwiched between underlying flue cap 16 and the cover 22 or 22A.

Referring to FIGS. 2-4, 7 and 7A, there is shown an optional trim ring 26. Trim ring 26 is adapted to fit over collar 54 of pipe ring 24. Trim ring 26 is adapted to cover an opening 19 in wall 10 of a building and provide an aesthetically pleasing appearance and function as a flashing. Trim ring 26 includes a top wall 90 and bottom wall 92. Extending from the interior of the top wall 90 is an upwardly extending annular ring 94 adapted to snuggly fit around collar 54 of pipe ring 24. Extending downwardly from the exterior of top wall 90 is outside wall 96. The bottom portion of wall 96 is adapted to seat adjacent to wall 10 of a building. Extending downwardly from bottom wall 92 is wall 98 adapted to provide a groove 100 between wall 96 and wall 98. In this groove, a sealant material, e.g. caulking, may be applied to attach trim ring 26 to wall 10 of a building. This will also seal trim ring 26 of flue cap cover 20 to wall 10 of a building. It is noted that wall 98 is preferably shorter than wall 96 and any excess sealant will thereby run over the bottom of wall 98 and not past wall 96.

Referring to FIGS. 3 and 4, there are shown views of an installed flue cap cover 20 with optional trim ring 26. The flue cap cover 20 is attached to the flue termination 12 at the end of a construction project with a worker standing on a boom lift to position him adjacent to each of the multiple flues 12 extending from a building wall 10. The flue cap cover 20 components are preferably of the same color and a color to match or contrast with the color of the building. The method of attaching flue cap cover 20 includes the following steps: a flue termination 12 includes a flue pipe 14 and flue cap 16; the flue cap 16 is removed from the flue termination 12; there is now an exposed flue pipe 14; an optional a trim ring 26 slides over flue pipe 14; a pipe ring 24 is attached to flue pipe 14; the optional trim ring 26 slides over the collar of pipe ring 24 and is adapted to seat on the wall 10 of the building and cover any opening 19 between wall 10 and flue pipe 14; flue cap 16 is re-attached to flue pipe 14 and ribs 18 are inserted into pipe ring 24; optionally, a screen 80 may be aligned over the top of flue cap 16; and cover 22 is thereafter overlayed on the flue cap 16 with lip 36 attaching to tabs 68 of pipe ring 24.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A flue cap cover for covering a flue termination extending from a building wall having a flue pipe and a flue cap wherein said flue cap includes a plurality of ribs adapted to attach said flue cap to said flue pipe comprising a pipe ring comprising an annular vertical wall adapted to fit over said flue pipe and having a plurality of legs extending outwardly from said annular vertical wall, said plurality of legs each including side walls and an opening adapted to receive one of said plurality of ribs of said flue cap, and a cover comprising a first open end adapted to fit over said flue cap and a second open end adapted to vent an exhaust wherein said cover is constructed and arranged to fit over and overlie said flue cap, wherein said flue cap cover may be made in different colors to match or contrast with the color of said building.

2. The flue cap cover of claim 1 wherein said pipe ring includes a collar portion and the collar portion optionally includes a plurality of segments.

3. The flue cap cover of claim 2 further comprising a trim ring adapted to fit over said pipe ring and adapted to cover an opening in the wall of said building and function as a flashing.

4. The flue cap cover of claim 1 further including a screen adapted to fit between a top wall of said flue cap and an interior wall of said cover.

5. The flue cap cover of claim 3 further including a screen adapted to fit between a top wall of said flue cap and an interior wall of said cover.

6. The flue cap cover of claim 1 wherein said flue cap is cone-shaped and said cover is cone-shaped.

7. The flue cap cover of claim 1 wherein said cover includes a lip member at a bottom of said cover and said pipe ring includes a plurality of tabs, each tab extending from one of said plurality of legs, wherein said cover is attached to said pipe ring by said lip portion fitting into said tabs.

8. The flue cap cover of claim 3 wherein said trim ring includes a top wall, a bottom wall, an annular ring extending from an interior portion of said top wall, and an outside wall extending downwardly from said top wall and adapted to seat on said building.

9. The flue cap cover of claim 8 wherein said bottom wall includes a wall extending downwardly therefrom to form a groove between said wall and said outside wall.

10. The flue cap cover of claim 1 wherein said cover includes a plurality of flexible flanges extending from a bottom wall of said cover and adapted to engage a bottom wall of said flue cap to attach said cover to said flue cap.

11. The flue cap cover of claim 3 wherein said cover, said pipe ring and said trim ring are made of plastic.

12. A method of attaching a flue cap cover to a flue termination extending from a building wall having a flue pipe and a flue cap wherein said flue cap includes a plurality of ribs adapted to attach said flue cap to said flue pipe, wherein said flue cap cover includes a pipe ring comprising an annular vertical wall adapted to fit over said flue pipe and having a plurality of legs extending outwardly from said annular vertical wall, said plurality of legs each including side walls and an opening adapted to receive one of said plurality of ribs of said flue cap, and a cover comprising a first open end adapted to fit over said flue cap and a second open end adapted to vent an exhaust wherein said cover is constructed and arranged to fit over and overlie said flue cap, wherein said flue cap cover may be made in different colors to match or contrast with the color of said building, comprising the steps of: (a) removing said flue cap from said flue termination and exposing said flue pipe; (b) attaching said pipe ring to said flue pipe; (c) reattaching said flue cap to said flue pipe wherein said plurality of ribs of said flue cap are inserted into said plurality of legs of said pipe ring; (d) optionally aligning a screen over the top of said flue cap; and (e) overlaying said cover on said flue cap and attaching said cover to said flue cap.

13. The method of claim 12 wherein said flue cap cover further includes a trim ring and said trim ring is attached to said flue pipe after said step (a) and said trim ring is placed over said pipe ring after step (b).

14. The method of claim 12 wherein said method is performed by a worker from a boom lift.

* * * * *